US005655866A

United States Patent [19]

Bellanca

[11] Patent Number: 5,655,866

[45] Date of Patent: Aug. 12, 1997

[54] METHOD OF FOLDING A SIGNATURE FOR USE IN BOOKBINDING

[76] Inventor: Joseph V. Bellanca, 1900 Country Meadows Ter., Sarasota, Fla. 34235

[21] Appl. No.: 412,311

[22] Filed: Mar. 20, 1995

[51] Int. Cl.[6] ..... B42C 9/00

[52] U.S. Cl. ..... 412/1; 493/357; 281/15.1; 281/21.1

[58] Field of Search ..... 412/1; 283/34, 283/106; 493/357–360; 281/38, 15.1, 21.1

[56] References Cited

U.S. PATENT DOCUMENTS

| | | | |
|---|---|---|---|
| 1,159,459 | 11/1915 | Wood | 281/38 |
| 1,177,806 | 4/1916 | Riegel | 281/38 |
| 1,480,236 | 1/1924 | Arelt | 493/360 |
| 1,759,191 | 5/1930 | Fulk | 493/357 |
| 1,831,246 | 11/1931 | Hitchcock | 493/342 |
| 3,228,710 | 1/1966 | Chodorowski | 281/38 |
| 3,843,113 | 10/1974 | Schaffer | 281/38 X |
| 5,156,898 | 10/1992 | McDonald | 283/106 X |

*Primary Examiner*—Frances Han
*Attorney, Agent, or Firm*—Charles J. Prescott

[57] ABSTRACT

An improved fully folded signature for subsequent use in gathering and combining or binding in bookbinding. The fully folded signature includes uniquely positioned perforated folds and sequences of folding which reduces folding time, alter folded signature orientation during gathering, and eliminates the need for having a conventional backbone.

10 Claims, 4 Drawing Sheets

16b
20
20a 22
22a
24a
24

28
24
26
24a
24'
30

24
32
34
24'
24b
24
36
24'
24a 40
42
46
52
48
46
44
44
46
48
45
50
44
46
48a
44
45'

(PRIOR ART)
Fig.7
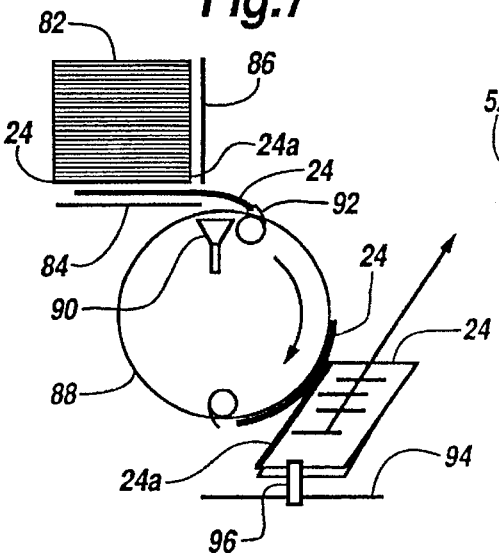
Fig.8
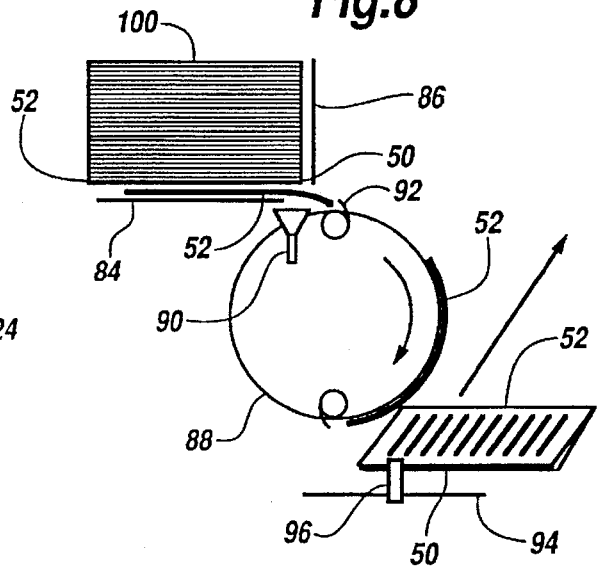
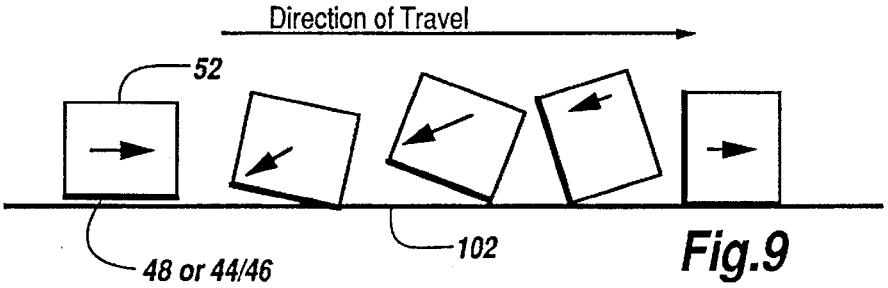
Fig.9
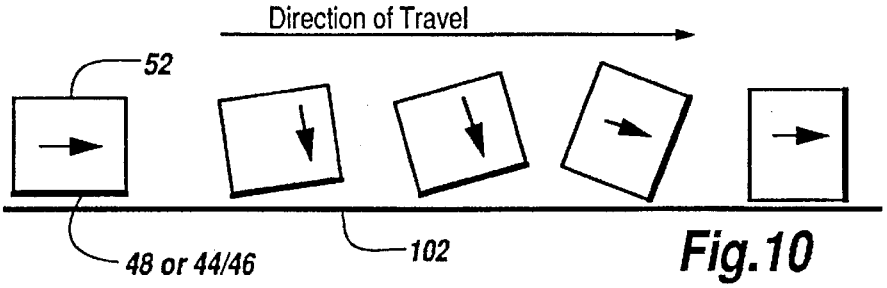
Fig.10
Fig.11
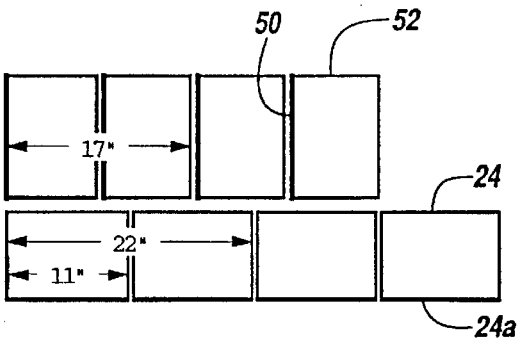

METHOD OF FOLDING A SIGNATURE FOR USE IN BOOKBINDING

BACKGROUND OF THE INVENTION

1. Scope of Invention

This invention generally relates to bookbinding and more particularly to a uniquely configured signature and method of folding which increased bookbinding efficiency.

2. Prior Art

Sequentially paged products such as books, pamphlets and magazines derive their origin of manufacture from ancient times, even before movable type, when calligraphic art and hand illuminating art were used by monks to tediously reproduce manuscript pages. The term "signature" is derived from the fact that the calligrapher and hand illuminator of a "quad", a single large sheet containing four to eight pages, identified his work by signing his name to the full sheet containing these pages. Therefore, the original building block of sequential page order still in use is the signature or the process of folding large sheets of paper containing pages into smaller, manageable units so that each page is held in a desired sequential order until bound together.

After the signature-in-the-flat has been completed, they are passed to a folding machine in which the large sheets are folded halfway down their length a number of times until the correct page size for the book and the correct sequence of page numbering is obtained. Thereafter, the folded signatures are placed in receiving hoppers of collating machines or gatherers and are withdrawn one at a time from each of as many hoppers as there are separate signatures in the book. Thus, from each hopper, one signature at a time is withdrawn from the bottom of each stack of signatures in each hopper and deposited on a traveling belt which then moves each signature along to the next hopper where the next signature is deposited on the first and so forth.

By conventional signature folding, this structure affords two important elements, both in the form of what is called the backbone or binding side. The backbone is first used for its multiple layer folded page strength to withdraw each signature one at a time from the bottom of the signature stack within each hopper. The backbone is then utilized to bind the signatures together to form the book.

Three separate methods of combining or binding the signatures together are utilized. The first and most popular method is by simply sewing the stacked signatures together to create combined pages. Another method utilized is "perfect or patent" binding wherein, after gathering, all of the backbones or binding sides are eliminated as by shearing so that the center pages of each signature are exposed. All of the exposed page edges are then joined to each other by applying adhesive thereto. A variation of the perfect or patent binding is entitled "burst binding" in which the folded sheets of each signature have perforations applied to the folded or binding side in an upstream process. These perforations allow certain types of adhesives to penetrate to the center pages. However, this process is limited to certain types of paper and adhesives and is generally limited to certain magazine and catalog productions due to the restrictions on paper, adhesives and drying time. The third method utilizes staples through the backbone in lieu of sewing for relatively small books.

During the signature folding process, each time the sheet must be turned or changed in direction to accommodate a fold orthogonal or perpendicular to the last, the fold speed is reduced considerably. In folding a signature by conventional means as above described, the material must be reoriented for each successive fold. By utilizing the present invention, only one change of direction is required which is estimated to increase press speeds and therefore production by as much as twenty percent (20%).

In addition, the present invention provides for perforations along fold lines in some selected folds so as to completely eliminate the need for a sheering or cutting process of the binding edge prior to effecting gluing thereof in perfect or patent binding. Perforated folds also reduce the size if the signature in the flat for added paper savings.

Downstream operations of each signature assembly require proper orientation so that the background preparation may be completed. This position requires that the folded edge of the assembled signatures normally in the long dimension, be turned to a suitable position for downstream tasks. One type of assembly machine requires that the signatures be reoriented with the backbone facing forwardly in the direction of travel, while other assembly machines require that the gathered signatures be turned or reoriented with the backbone facing rearwardly. The present invention provides a perforated binding edge along either side edge and thus accommodates either form of assembly equipment.

BRIEF SUMMARY OF THE INVENTION

This invention is directed to an improved fully folded signature for subsequent use in gathering and combining or binding in bookbinding. The fully folded signature includes uniquely positioned perforated folds and sequences of folding which reduces folding time, alter folded signature orientation during gathering, and eliminates the need for having a conventional backbone.

It is therefore an object of this invention to provide a method of folding a signature which minimizes the need for reorienting after each fold, thus reducing sequential folding time.

It is another object of this invention to provide a method of folding a signature which eliminates the need for sheering the folded backbone or binding side prior to perfect or patent binding which utilizes adhesive.

It is still object of this invention to provide a method of folding a signature which reduces paper waste in bookbinding.

It is yet another object of this invention to provide a uniquely folded signature which may be utilized in conjunction with bookbinding assembly equipment which orients the binding side in either forwardly or rearwardly direction for use with all existing equipment.

It is yet another object of this invention to provide an improved signature for use in bookbinding.

In accordance with these and other objects which will become apparent hereinafter, the instant invention will now be described with reference to the accompanying drawings.

BRIEF DESCRIPTION OF THE DRAWINGS

FIG. 7 is a perspective view of conventional folded signature gathering.

FIG. 8 is a perspective view of improved folded signature gathering using the present invention.

FIGS. 9 and 10 are side elevation schematic views of alternate modes of reorienting assembled signatures in preparation for final binding.

FIG. 11 is a schematic view comparing signature transport spacing of the present invention and conventional signatures.

DETAILED DESCRIPTION OF THE INVENTION

Figure 1:
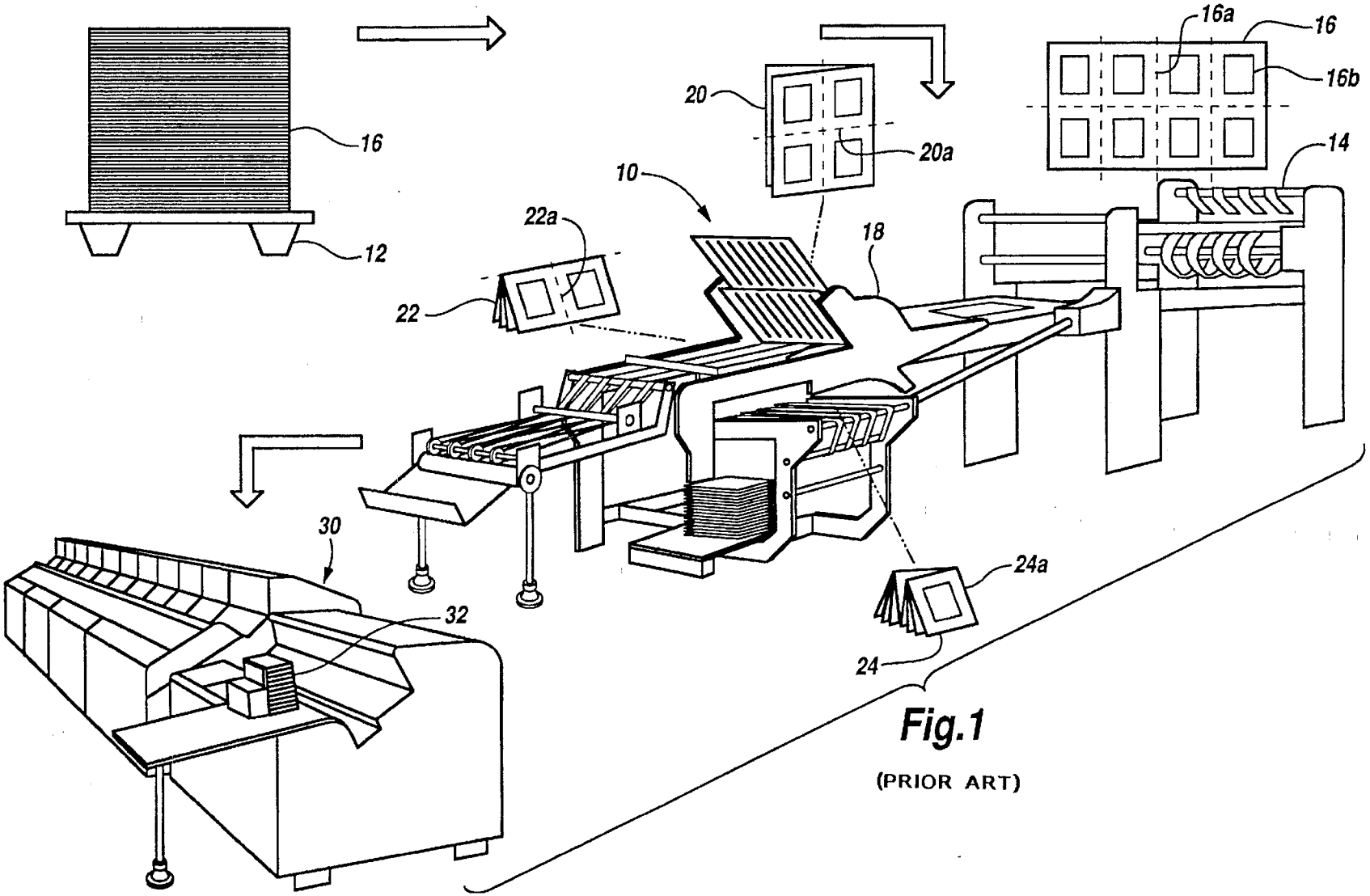
Fig.1 (PRIOR ART)
FIG. 1 is a perspective view of conventional signature folding and signature gathering equipment.
Figure 2:
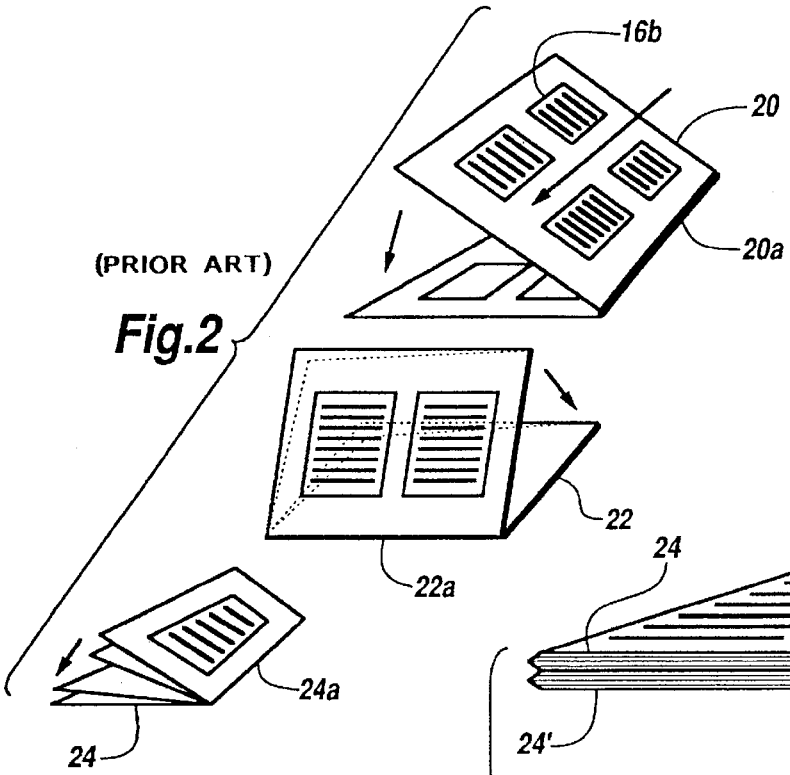
(PRIOR ART) Fig.2
FIG. 2 is a perspective view of the conventional signature folding sequence.
Figure 3:
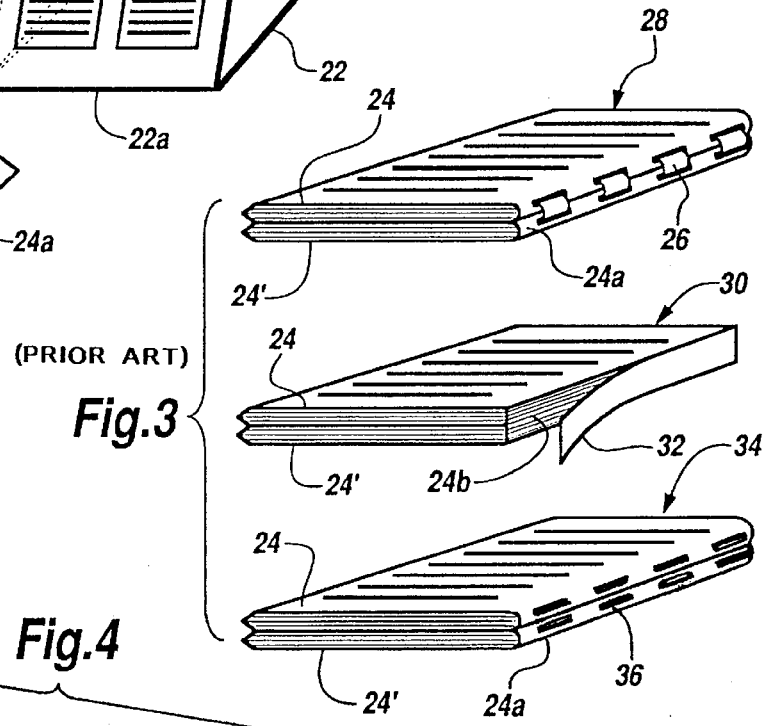
(PRIOR ART) Fig.3
FIG. 3 is a perspective view of alternate methods of combining or binding signatures together to form a book.

Referring now to the drawings, the techniques and equipment utilized in conventional signature folding, gathering and binding are shown in FIGS. 1 to 3. In FIG. 1, signature sheets in-the-flat 16 are received from stacks 12, each signature in-the-flat 16 having pages of viewable and/or readable indicia 16*b* printed thereon.

Each signature in-the-flat 16 is received into a folding machine shown generally at numeral 10 in which each signature is folded halfway down its length a number of times until the current page size for the book is obtained. The first stage of folding at 14 occurs about fold line 16*a* to become once folded signature 20. Thereafter, at 18, the once folded signature 20 is folded about fold line 20*a* to become twice folded signature 22. Thereafter, the twice folded signature 22 is folded about fold line 22*a* and conveyed from the folding machine 10 as a completely folded signature 24. This folding sequence is shown in perspective in FIG. 2. The fully folded signature 24 further defines a backbone or binding edge 24*a* for use in later gathering and binding processing and assembly. Note that each signature must be rotated 90° three times, once for each fold, increasing fold time.

Each book normally includes or is made up of several folded signatures. When stacked one atop another in a proper sequence, the folded signatures thus define properly ordered sequential pages which define the end book product.

Still referring to FIG. 1, after all of the signatures 24 are folded, they are stacked in individual hoppers of a collating machine or gatherer shown generally at numeral 30. The gatherer 30 has as many hoppers as needed to accommodate corresponding number of signatures in the book being gathered. From each hopper, one folded signature 24 (typ.) at a time is deposited on a traveling belt which then moves it along to the next hopper, where the next signature is deposited on the first and so forth.

In FIG. 3, the methods of combining or binding the assembled signatures are there shown. For simplicity, only two signatures 24 and 24' are shown to form the assembled book. The first arrangement 28 demonstrates the well-known and still widely used assembly process of sewing wherein stitching at 26 (typ.) secures or binds the signatures 24 and 24' through the folded backbone 24*a* (typ.).

The binding process known as perfect or patent binding of two signatures 24 and 24' to produce the book 30 utilizes a layer of adhesive 32 applied after the folded backbone has been sheered off to produce a straight cut surface 24*b*. A variation of this gluing method known as burst binding produces book 34. In burst binding, perforations 36 have previously been applied to the folded or binding side 24*a* (typ.) to enhance adhesive penetration. However, burst binding process is limited to specific adhesives, paper content and drying time.

Figure 4:
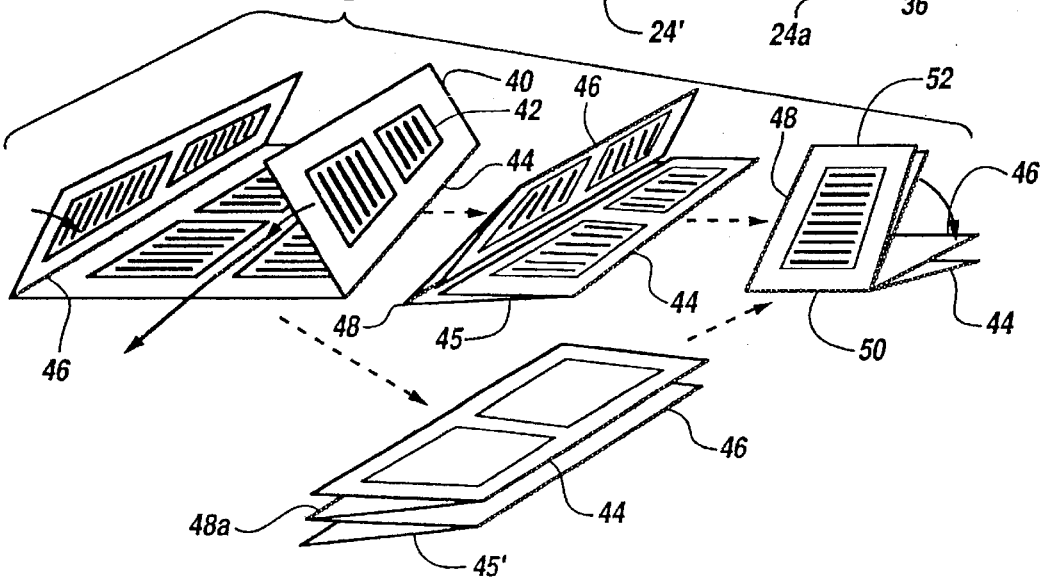
FIG. 4 is a perspective view showing the signature folding sequence of the present invention.

Referring now to FIG. 4, the improved folded signature 52 and the method of folding same are there depicted. The signature in-the-flat, moving in the direction of the arrow within the folding machine 10 of FIG. 1, is initially folded along fold lines 44 and 46 which are transversely oriented to the length of the signature and spaced one quarter of the overall length of the signature from each end thereof to define a twice folded signature 40. Thereafter, the signature is folded again about fold line 48 transversely oriented and centrally positioned from each end of the signature in-the-flat. This produces a three-times folded signature 45. Lastly, the signature is folded into its final form 52 by folding along fold line 50 positioned halfway between the length of the three-times folded signature 45. Alternately, the twice-folded signature 40 may be folded about fold line 48*a* in the opposite direction to produce three-times folded 45' within the scope of the invention. Note that the signature only needs to be rotated through 90° once as the first three folds at 44, 46 and 48 are parallel to one another.

In the preferred embodiment of the invention shown in FIG. 4 resulting in the fully folded signature 52, all of the fold lines 44, 46, 48, 48*a* and 50 are perforated as well. The primary objective of the perforations along these folds is to produce a side binding edge 48 or 44/46 which eliminates the need for further preparation in accomplishing a glued perfect or patent-bound edge. The perforations allow adhesive penetration in conjunction with specific paper types. However, where folding equipment may be selectively structured, only one former fold 48 or 44/46 need be perforated, that being the fold which will form the to-be-glued biding edge.

Figure 5:
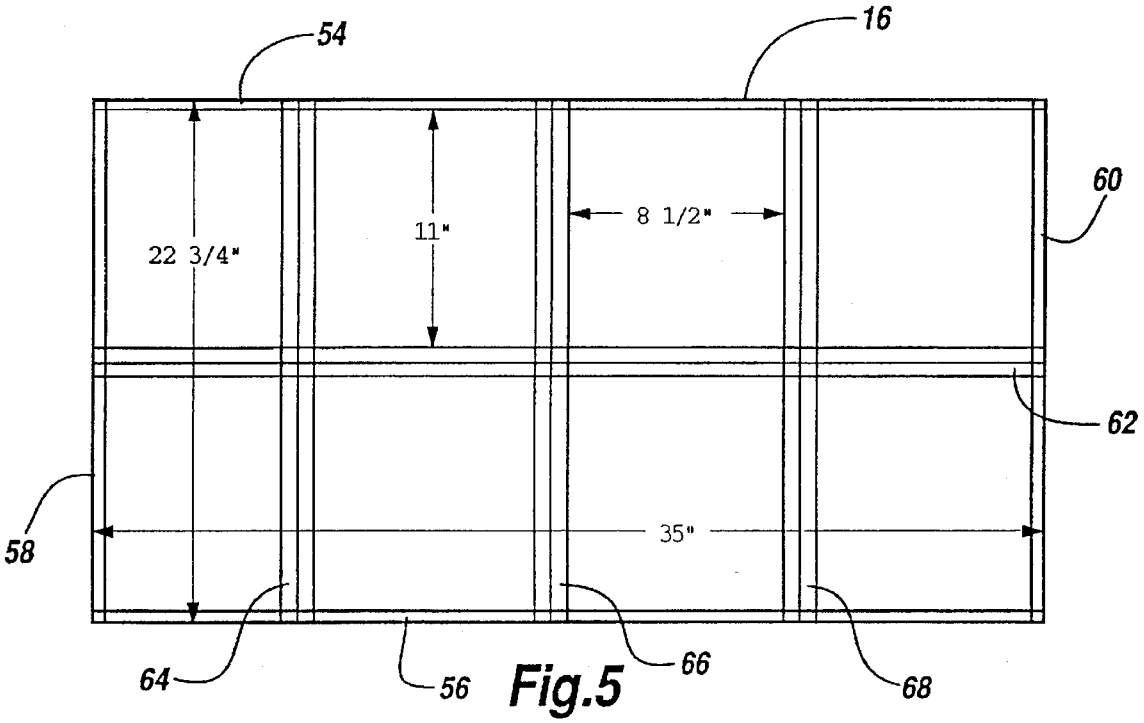
Fig.5 (PRIOR ART)
FIG. 5 is a plan view of a conventionally folded and trimmed signature in the flat.
Figure 6:
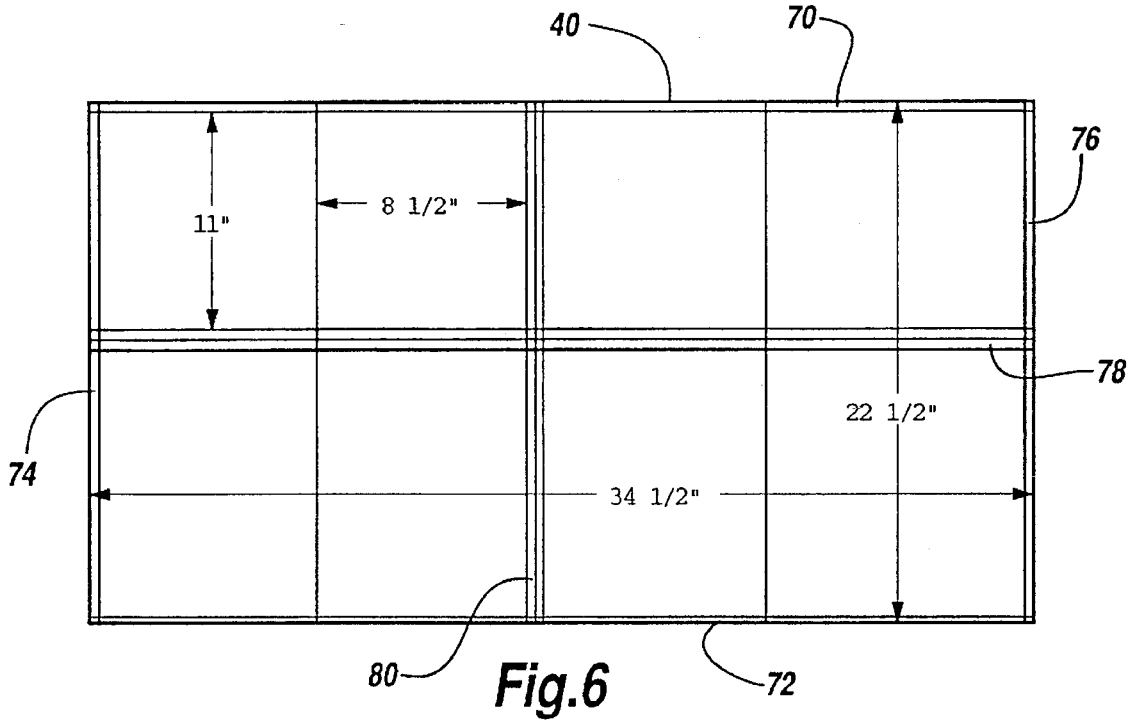
FIG. 6 is a plan view of a signature in the flat folded and trimmed by teachings of the present invention.

Comparing FIGS. 5 and 6, the paper savings feature of the present invention resulting in the utilization of perforations for adhesive binding is there shown. In FIG. 5, the conventionally folded signature in-the-flat 16 shows that, after necessary trimming, strips 64 and 68 are eliminated as a result of sheering and binding, while strips 62, 66, 54 and 60 are also removed as a result of trimming all three remaining page edges. In FIG. 6, only strips 78 and 80 are removed as a result of page trimming, along with strips 70, 72, 74, and 76 as a result of trimming remaining page edges. The net result of this paper size savings is that, to achieve a conventional final page size of 8½"×11", the required overall signature in-the-flat size is reduced in length from 35" to 34½" and in width from 22¾" to 22½". This represents a paper savings of 2.5%.

In pulling each folded signature 24 from the bottom of a stack thereof within the corresponding hopper of the collating machine 30, these mechanisms depend upon the strength of the folded binding edge 22*a* of the conventionally folded signature 24 as best seen in FIGS. 1 and 2. A finger is utilized to pass between the central panels of the folded signature 24 and then withdraws that signature for further assembly. The present invention provides this folded edge structure at fold 50 even though this fold 50 does not ultimately become the binding edge of the folded signature 52.

Some of the important operational assembly benefits of the present invention are shown in FIGS. 7 to 11. In FIG. 7, the removal of each conventionally folded signature 24 from each signature stack 82 within hopper 86 is effected by a rotary drum 88 having a vacuum source 90 and a gripper 92. As this drum 88 rotates, the binding side 24*a* of each folded signature 24 is thus deposited onto a transport channel or conveyor 94 and pushed along by pusher 96. Note that the longest dimension of the folded signature 24 is oriented longitudinally with respect to the transport channel 94 in the direction of travel.

In FIG. 8, the present invention provides the improved folded signature 52 positionable within hopper 86 in stacks 100 so that the folded edge 50, being the longest dimension, is oriented transversely to the direction of the flow of movement on transport channel 94. By this arrangement, the length of time to gather the signatures is significantly reduced while still presenting a necessary folded edge 50 to effect the signature removal in the gathering equipment.

This is perhaps more easily understood as shown in FIG. 11 wherein the arrangement of four conventionally folded signatures 24 are shown as they would appear on a transport channel along side four folded signatures 52 in accordance with the present invention. The overall transport length is reduced from multiples of 22 down to multiples of 17, assuming at least two folded signatures are required to complete the book.

In FIGS. 9 and 10, another unique benefit of the present invention is there shown in terms of the options for orienting the gathered assembled signatures shown for convenience at 52. These operations downstream of gathering require on conventional existing equipment that the assembled signatures be positioned so that backbone preparation can take place. This position requires that the binding edge 48 or 44/46 of the folded signatures 52 (refer back to FIG. 4) be turned to either a forwardly or a rearwardly orientation, depending upon the particular existing binding equipment 102 chosen. Thus, utilizing the improved folded signature structure of the present invention, the gathered signatures may be rotated in either direction, regardless of equipment chosen or available in the process of effecting binding.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A method of folding a signature having preprinted indicia on at least one surface thereof defining separate uniformly spaced regions or zones of said signature, comprising the steps of:

A. perforating and folding said signature transversely to a length thereof at one quarter of said length from each end of said signature to define first and second parallel fold lines which establish a binding edge adapted for enhanced adhesive penetration;

B. folding said signature transversely to said length halfway along said length a third fold line;

C. folding said signature halfway along a remaining length of said signature to define a fourth fold line.

2. A method as set forth in claim 1, wherein:

folding of said signature transversely as set forth in Step B is in a same direction as that of folding said signature transversely as set forth in Step A.

3. A method as set forth in claim 1, wherein:

folding of said signature transversely as set forth in Step B is in an opposite direction from that of folding said signature transversely as set forth in Step A.

4. A fully folded signature ready for gathering in bookbinding, comprising:

a generally rectangular paper sheet having a length and a width and printed indicia thereon to define a signature, said printed indicia defining separate uniformly spaced areas of said signature;

a first perforated fold extending transversely across said width one quarter of said length from one end of said signature;

a second perforated fold extending transversely across said width one quarter of said length from another end of said signature;

a third fold extending transversely across said width halfway between each end of said signature whereby said first and second perforated folds are substantially parallel and substantially aligned one to another;

a fourth fold extending transversely across a width, and centrally positioned between each edge of, a partially folded signature formed after said first, second and third folds are made;

said fourth fold defining a pulling edge for use in gathering fully folded signatures prior to binding.

5. A folded signature as set forth in claim 4, wherein:

said third fold is perforated.

6. A folded signature as set forth in claim 5, wherein:

said printed indicia is arranged on said signature to establish said third perforated fold as a binding edge.

7. A folded signature as set forth in claim 5, wherein:

said printed indicia is arranged on said signature to establish said first and second perforated folds substantially aligned one to another as a binding edge.

8. A fully folded signature having printed indicia on at least one surface thereof defining separate uniformly spaced regions or zones said folded signature formed by the steps of:

A. perforating and folding a signature in-the-flat transversely to a length thereof at one quarter of said length from each end of said signature along a first and a second fold line;

B. folding said signature transversely to said length half way down said length along a third fold line;

C. folding said signature half way down a remaining length of said signature to define a fourth fold line.

9. A method of folding a signature and gathering a plurality of folded signatures for binding into a book, each said signature formed of a rectangular sheet of paper having preprinted indicia on at least one surface thereof which defines separate uniformly spaced regions or zones of said signature, comprising the steps of:

A. folding said signature transversely to a length thereof at one quarter of said length from each end of said signature to define first and second parallel folds;

B. folding said signature transversely to said length halfway along said length a third fold;

C. folding said signature halfway along a remaining length of said signature to define a fourth fold which defines a pulling edge;

D. stacking a plurality of said folded signatures into each hopper of a collating machine;

E. sequentially pulling one said folded signature at a time from each said hopper by gripping engagement with said pulling edge;

F. sequentially combining a plurality of said folded signatures into a book ready for binding.

10. A method of folding a signature having preprinted indicia on at least one surface thereof defining separate uniformly spaced regions or zones of said signature, comprising the steps of:

A. folding said signature transversely to a length thereof at one quarter of said length from each end of said signature to define first and second parallel fold lines;

B. perforating and folding said signature transversely to said length halfway along said length a third fold line which establish a binding edge adapted for enhanced adhesive penetration;

C. folding said signature halfway along a remaining length of aid signature to define a fourth fold line.

* * * * *